US011602016B2

(12) United States Patent
Song

(10) Patent No.: US 11,602,016 B2
(45) Date of Patent: Mar. 7, 2023

(54) ELECTRIC HEATER AND ELECTRIC HEATING APPARATUS HAVING SAME

(71) Applicant: LG ELECTRONICS INC., Seoul (KR)

(72) Inventor: Misun Song, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 178 days.

(21) Appl. No.: 16/595,011

(22) Filed: Oct. 7, 2019

(65) Prior Publication Data

US 2020/0120759 A1 Apr. 16, 2020

(30) Foreign Application Priority Data

Oct. 16, 2018 (KR) ..... 10-2018-0123152

(51) Int. Cl.

| | |
|---|---|
| ***H05B 3/03*** | (2006.01) |
| ***H05B 3/20*** | (2006.01) |
| *F24C 7/00* | (2006.01) |
| *F24D 15/00* | (2022.01) |

(52) U.S. Cl.

CPC ..... *H05B 3/03* (2013.01); *H05B 3/20* (2013.01); *F24C 7/00* (2013.01); *F24D 15/00* (2013.01); *H05B 2203/005* (2013.01); *H05B 2203/014* (2013.01)

(58) Field of Classification Search

CPC ... H05B 3/03; H05B 3/10; H05B 3/20; H05B 3/22; H05B 3/26; H05B 3/265; H05B 3/32; H05B 2203/002; H05B 2203/003; H05B 2203/004; H05B 2203/005; H05B 2203/0017; H05B 2203/013; H05B 2203/0014

See application file for complete search history.

(56) References Cited

U.S. PATENT DOCUMENTS

| | | | | |
|---|---|---|---|---|
| 4,286,377 | A | 9/1981 | Hurko et al. | |
| 4,393,299 | A | 7/1983 | McWilliams | |
| 6,018,149 | A | 1/2000 | Higgins | |
| 9,320,293 | B2 * | 4/2016 | Weiss | A23L 7/187 |
| 10,531,521 | B2 | 1/2020 | Korkusuz et al. | |
| 2003/0075537 | A1 * | 4/2003 | Okajima | H01L 21/67103 219/444.1 |
| 2004/0182850 | A1 | 9/2004 | Wilde et al. | |
| 2010/0193502 | A1 * | 8/2010 | Kim | H05B 3/748 219/482 |

(Continued)

FOREIGN PATENT DOCUMENTS

| | | | |
|---|---|---|---|
| CN | 102685942 | A | 9/2012 |
| DE | 3545443 | A1 | 6/1987 |

(Continued)

*Primary Examiner* — Justin C Dodson

(74) *Attorney, Agent, or Firm* — Dentons US LLP

(57) ABSTRACT

An electric heater includes a substrate, an outer pattern part disposed on one surface of the substrate, an inner pattern part disposed on the one surface of the substrate so as to be located such that the outer pattern part surrounds the inner pattern part, and to be spaced apart from the outer pattern part. A pair of first electrodes is connected to the outer pattern part and a pair of second electrodes is connected to the inner pattern part and spaced apart from the pair of first electrodes, and the pair of second electrodes are located inside the outer pattern part.

11 Claims, 6 Drawing Sheets

(56) References Cited

U.S. PATENT DOCUMENTS

| | | | | |
|---|---|---|---|---|
| 2017/0295612 | A1* | 10/2017 | Smith | H05B 3/283 |
| 2018/0092161 | A1* | 3/2018 | Kurano | H05B 3/22 |
| 2019/0182908 | A1 | 6/2019 | Oh et al. | |

FOREIGN PATENT DOCUMENTS

| | | | |
|---|---|---|---|
| DE | 102006022571 | A1 | 11/2007 |
| EP | 0 228 808 | A2 | 7/1987 |
| EP | 0230555 | A2 | 8/1987 |
| EP | 0930805 | A2 | 7/1999 |
| FR | 2494403 | A1 | 5/1982 |
| GB | 2340713 | A | 2/2000 |
| JP | 2014053574 | A | 3/2014 |
| KR | 1020090009600 | A | 1/2009 |
| KR | 10-2017-0002715 | U | 7/2017 |
| KR | 10-1762159 | B1 | 8/2017 |
| KR | 1020170138304 | A | 12/2017 |
| KR | 1020180096413 | A | 8/2018 |
| SI | 1448024 | T1 | 4/2008 |
| WO | 2007/131852 | A1 | 11/2007 |
| WO | 2016030719 | A1 | 3/2016 |

* cited by examiner

ELECTRIC HEATER AND ELECTRIC HEATING APPARATUS HAVING SAME

CROSS-REFERENCE TO RELATED APPLICATION

This application claims the benefit of priority to Korean Patent Application No. 10-2018-0123152 filed on Oct. 16, 2018 with the Korean Intellectual Property Office, the entire contents of which is incorporated herein by reference.

BACKGROUND

The present disclosure relates to an electric heating apparatus, and to an electric heater having a plane heating element.

An electric heating apparatus is an apparatus provided for heating, and includes an electric heater using a Joule's heat generated as current flows through a resistance wire or the like, and an electric heater generating heat by visible light or infrared light.

The electric heating apparatus may be a cooking device such as a cooktop stove, an electric range, etc., to heat food or a container (hereinafter, referred to as a heating object) by generating heat using electricity. The electric heating apparatus may be a heating radiator. Recently, the electric heater using a plane heating element has gradually increased.

An example of such electric heater is disclosed in Korean Patent Registration No. 10-1762159 B1 (issued on Aug. 4, 2017). The plane heating electric heater includes a substrate including a surface formed of a material having an electric insulating property, a heating element attached to the surface of the substrate and disposed in a specific shape, and a power supply unit to supply electricity to the heating element.

In the above-described electric heater, the temperature distribution of the heating object may be varied depending on the shape or pattern in which the plane heating element is disposed. Preferably, the plane heating element is formed in the shape or pattern for heating the heating object uniformly as much as possible.

The plane heating element of the electric heater may include a plurality of track parts having a straight line or an arc shape, and adjacent track parts of the plurality of track parts may have the shape of that of the adjacent track parts, and are connected with each other through a bridge part (or track part).

In another example of the heater, there is a temperature sensitive device disclosed in EP 0, 228, 808 A2 (published on Jul. 15, 1987). Such a device is configured to have a structure of a heater track, which is an electrically conductive material, and a pair of electrodes printed on a ceramic coating layer. As the current is supplied through the electrode, radiant heat may be generated from the heater track.

SUMMARY

One aspect is to provide an electric heater having a large heating area at an outer pattern part.

An electric heater may include a substrate; an outer pattern part configured to be disposed on one surface of the substrate and to connect a start point and an end point; an inner pattern part configured to be disposed on one surface of the substrate so as to be located inside the outer pattern part, to be spaced apart from the outer pattern part, and to connect a start point and an end point; a pair of first electrode parts configured to be connected to the outer pattern part; and a pair of second electrode parts configured to be connected to the inner pattern part and spaced apart from the pair of first electrode parts, and in which the pair of second electrode parts may be located inside the outer pattern part.

The pair of second electrode parts may extend inwardly of the inner pattern part.

The pair of first electrode parts may extend outwardly of the outer pattern part.

The inner pattern part may include a pair of first inner tracks having an arc shape and to which the pair of second electrode parts are connected, respectively; a pair of second inner tracks having an arc shape, located inside the first inner track, and spaced apart from the first inner track; and a pair of first inner bridges connecting the first inner track and the second inner track in series; and in which the second electrode part may intersect an imaginary circle including an outer circumference of the second inner track.

A gap between the first inner track and the second inner track may be constant.

The inner pattern part may further include a pair of third inner tracks having an arc shape, located inside the second inner track, and spaced apart from the second inner track; and a pair of second inner bridges connecting the second inner track and the third inner track to each other in series, and in which the second electrode part may face between the pair of second inner bridges.

The inner pattern part may further include a pair of third inner tracks having an arc shape, located inside the second inner track, and spaced apart from the second inner track; and a pair of second inner bridges connecting the second inner track and the third inner track to each other in series, and in which a distance between the pair of second inner bridges may be farther than a distance between the pair of first inner bridges.

The outer pattern part may include a pair of first outer tracks having an arc shape and to which the pair of first electrode parts are connected, respectively; a pair of second outer tracks having an arc shape, located inside the first outer track, and spaced apart from the first outer track; and a pair of first outer bridges connecting the first outer track and the second outer track to each other in series, and a distance between the pair of second inner bridges may be farther than a distance between the pair of first outer bridges.

A width of the first outer track and the second outer track may be different from that of the first inner track, the second inner track, and the third inner track.

The outer pattern part may have a spiral shape.

The pair of first electrode parts may include an outer electrode part extending outwardly of the outer pattern part; and an inner electrode part extending inwardly of the outer pattern part.

The inner electrode part may intersect an imaginary circle including an outer circumference of the inner pattern part and is spaced apart from the inner pattern part.

At least a part of the inner electrode part may be located between the pair of second electrode parts.

The inner pattern part may have a symmetrical shape with respect to an imaginary center line passing through the center of the inner pattern part, and the inner electrode part may intersect the imaginary center line.

The inner pattern part may include a pair of first inner tracks having an arc shape and connected to the pair of second electrode parts, respectively; a pair of second inner tracks having an arc shape, located inside the first inner track, and spaced apart from the first inner track; and a pair of first inner bridges connecting the first inner track and the second inner track to each other in series; and in which a gap between the first inner track and the outer pattern part may be varied along a length direction of the outer pattern part.

An electric heater may include a substrate; an outer pattern part configured to be disposed on one surface of the substrate, the outer pattern part including a plurality of outer tracks having an arc shape and a plurality of outer bridges connecting the plurality of outer tracks in series; an inner pattern part configured to be disposed on one surface of the substrate so as to be located inside the outer pattern part, the inner pattern part including a plurality of inner tracks having an arc shape and a plurality of inner bridges connecting the plurality of inner tracks in series; a pair of first electrode parts configured to be connected to an outer track located at the outermost side of the plurality of outer tracks; and a pair of second electrode parts configured to be connected to an inner track located at the outermost side of the plurality of inner tracks, in which the second electrode part may be located further inside than an outer track located at an innermost side of the plurality of outer tracks.

The second electrode part may face between a pair of inner bridges facing each other.

An electric heater include a substrate; an outer track configured to be disposed on one surface of the substrate and having a spiral shape; an inner pattern part configured to be disposed on one surface of the substrate so as to be located inside the outer track, the inner pattern part including a plurality of inner tracks having an arc shape and a plurality of inner bridges connecting the plurality of inner tracks to each other in series; an outer electrode part configured to be connected to an outer end part of the outer track; an inner electrode part configured to be connected to an inner end part of the outer track; and a pair of second electrode parts configured to be connected to an inner track located at the outermost side of the plurality of inner tracks.

The inner electrode part may face between a pair of inner bridges facing each other.

The inner electrode part may face between the pair of second electrode parts.

According to the disclosure, since the pair of second electrode parts are located inside the outer pattern part, there is an advantage that the heating region of the outer pattern part is large relatively.

Since the second electrode part extends to the inside of the inner pattern part, there is an advantage that the heating region of the outer pattern part is not invaded.

Since the first electrode part extends outside the outer pattern part, there is an advantage that the heating region of the outer pattern part is not invaded.

The second electrode part may extend inside the outer circumference of the second inner track by intersecting the imaginary circle including the outer circumference of the second inner track. As a result, a sufficient length may be ensured without the second electrode part interfering with the second inner track.

The second electrode part may face between the pair of second inner bridges. As a result, the second electrode part may secure a sufficient length without interfering with the second inner bridge.

The distance between the pair of second inner bridges may be wider than the distance between the other inner bridges facing each other. As a result, the heating area of the inner pattern part may be increased.

The distance between the pair of second inner bridges may be wider than the distance between the outer bridges facing each other. As a result, the heating area of the outer pattern part may be increased.

The outer pattern part may have a spiral shape. As a result, local heating may not occur in the outer pattern part.

The inner electrode part may intersect with an imaginary circle including an outer circumference of the inner pattern part and be spaced apart from the inner pattern part. As a result, compared with a case where the inner electrode part is located outside the outer circumference of the inner pattern part, the heating area of the inner pattern part may be made larger.

At least a part of the inner electrode parts may be located between the pair of second electrode parts. As a result, the supply of current to the second electrode part of the pair of second electrode parts, which has the same polarity as the inner electrode part, and the inner electrode part may be further facilitated.

DETAILED DESCRIPTION OF THE EMBODIMENTS

Hereinafter, the embodiments of the present disclosure will be described in detail with reference to accompanying drawings.

In describing the components of the embodiment(s) of the present disclosure, terms such as first, second, A, B, (a), and (b) may be used. These terms are only for distinguishing the components from other components, and the nature, order or order of the components are not limited by the terms. If a component is described as being "connected", "coupled" or "connected" to another component, it should be understood that the component may be directly connected or connected to that other component, but having other components there between.

Figure 1:
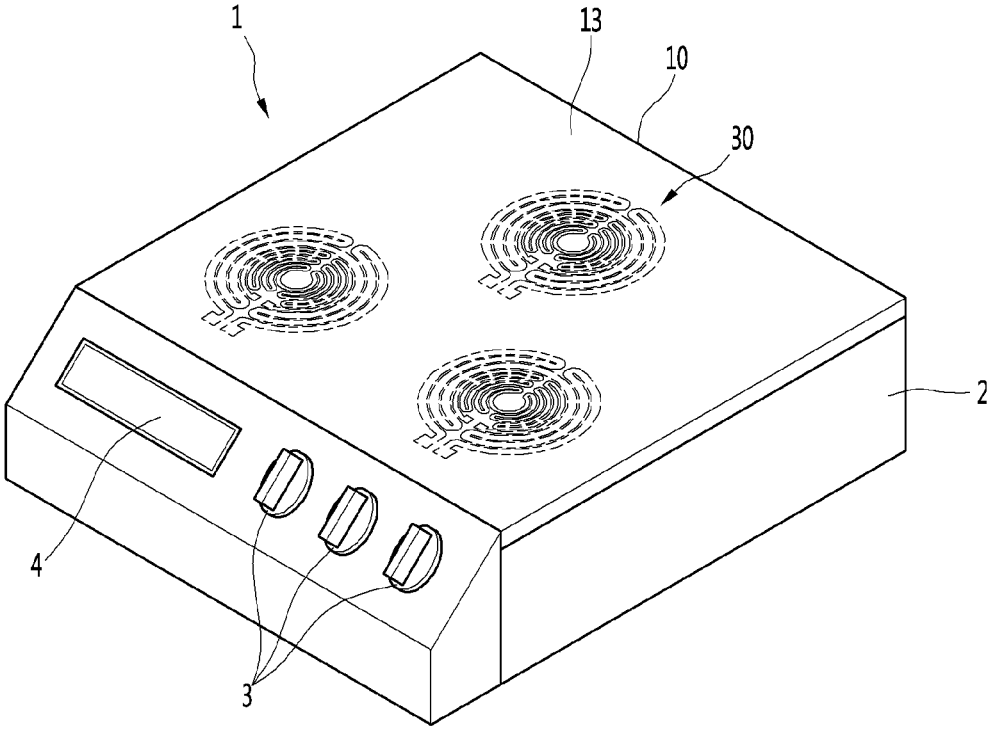
FIG. 1 is a perspective view showing an electric range employing an electric heater according to an embodiment of the present disclosure.
Figure 2:
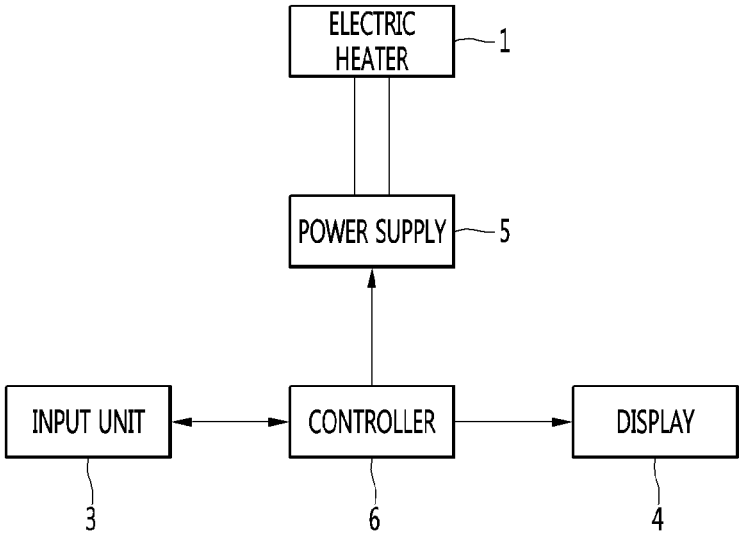
FIG. 2 is a control block diagram of an electric range employing an electric heater according to an embodiment of the present disclosure.

FIG. 1 is a perspective view showing an electric range employing an electric heater according to an embodiment of the present disclosure and FIG. 2 is a control block diagram of the electric range employing the electric heater according to an embodiment of the present disclosure. Although the electric heater shown is employed in an electric range, the electric heater may be employed in any electric heating apparatus.

An electric heater 1 may include some of an electric range (hereinafter, referred to as "electric range"), such as cooktop stove.

The electric range may include a cabinet 2 forming an outer appearance. The electric heater 1 may be disposed at an upper part of the cabinet 2. The cabinet 2 may have an open top surface, and the electric heater 1 may be disposed on the cabinet 2.

The electric range may include an input unit 3, which may be dials as shown, or may be touch buttons to manipulate the electric range, and a display 4 to display various information such as information of the electric range. The electric range may further include a power supply 5 connected with the electric heater 1 to supply current to the electric heater 1. The electric range may further include a controller 6 to control the power supply 5 and the display 4, depending on the input of the input unit 3. The controller 6 may be a microprocessor, an integrated circuit, an electrical circuit, a logical electrical circuit, and the like.

The electric heater 1 may be installed in the cabinet 2 such that the top surface of the electric heater 1 is exposed to the outside. The heating object heated by the electric range may be placed on the top surface of the electric heater 1 and the top surface of the electric heater 1 may be a heating object seating surface on which the heating object is seated.

Figure 3:
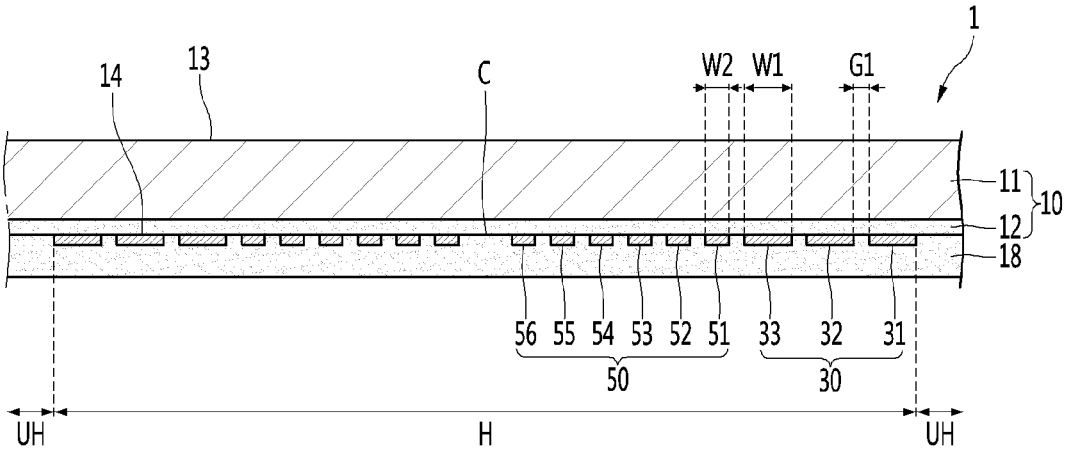
FIG. 3 is a cross-sectional view showing an electric heater according to a first embodiment of the present disclosure.

FIG. 3 is a cross-sectional view showing an electric heater according to a first embodiment of the present disclosure.

The electric heater 1 may include a substrate 10 and a first plane heating element 30 disposed on one surface of the substrate 10.

The substrate 10 may be, for example, an insulating substrate capable of forming a conductor pattern on the surface of the substrate 10. The top surface of the substrate 10 may be a heating object seating surface 13 on which the heating object is placed. The bottom surface of the substrate 10 may be a plane heating element surface 14 on which the first plane heating element 30 and a second plane heating element 50 to be described are disposed.

The substrate 10 may include only the base 11 formed of an insulating material in the entire portion thereof, or may include the base 11 formed of an insulating material or a non-insulating material and an insulating layer 12 disposed on one surface of the base 11.

The base 11 may include glass, and the insulating layer 12 may be disposed through coating or printing on the bottom surface of the glass or attached to the base 11.

The first plane heating element 30 may be directly disposed on one surface of the base 11 including the insulating material, or may be disposed on the insulating layer 12.

The base 11 may be formed in the shape of a plate on which the heating object is placed, and may be formed in the shape of a container in which the heating object may be received.

The insulating layer 12 may be disposed on the bottom surface of the base 11. The insulating layer 12 may be disposed on the entire portion of the bottom surface of the base 11 or on some of the bottom surface of the base 11. Alternatively, the insulating layer 12 may be disposed on an area in which the first plane heating element 30 and the second plane heating element 50 to be described are disposed. The insulating layer 12 may constitute the entire portion of the bottom surface of the substrate 10 or constitute some of the bottom surface of the substrate 10.

The first plane heating element 30 and the second plane heating element 50 may be disposed on the bottom surface 14 of the insulating layer 12. The first plane heating element 30 and the second plane heating element 50 may have a size smaller than a size of the substrate 10. The bottom surface of the base 10 may include a heating area H in which the first plane heating element 30 and the second plane heating element 50 are disposed, and a non-heating area UH around the heating area H.

The heater 1 may further include a coating layer 18 surrounding the first plane heating element 30 and the second plane heating element 50. The coating layer 18 may be formed of an electrically insulating material and may protect the first plane heating element 30 and the second plane heating element 50.

According to the present disclosure, the substrate 10 may include a flexible material, for example, a flexible insulating film. In this case, the electric heater 1 may be a flexible plane heater. It may be understood that such a flexible plane heater is attached to a member, on which the heating object is placed, to heat the heating object, which is similar to the top surface of the electric range.

Figure 4:
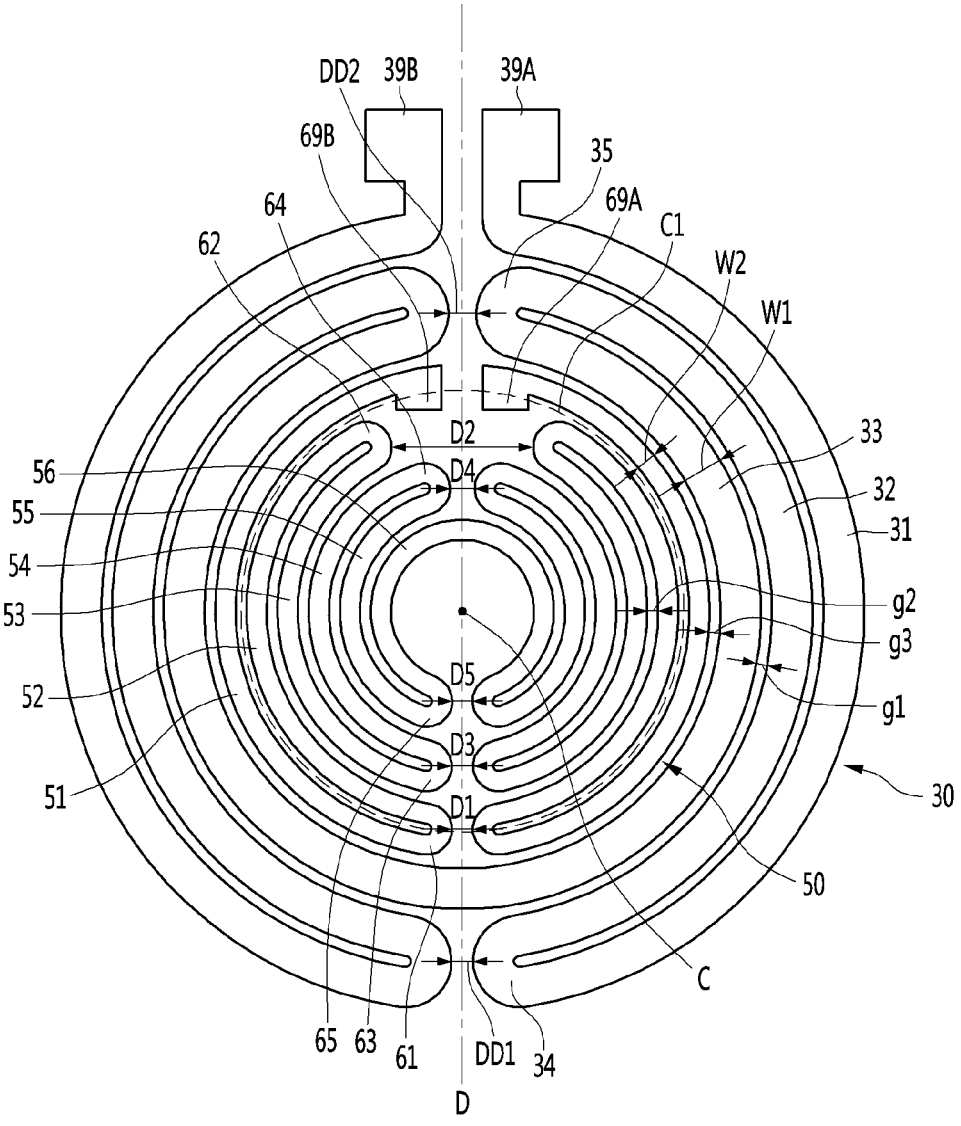
FIG. 4 is a bottom view showing an electric heater according to an embodiment of the present disclosure.

FIG. 4 is a bottom view showing an electric heater according to an embodiment of the present disclosure.

The inner direction described in the present specification may be a direction toward the center of the first plane heating element 30 and the second plane heating element 50, and the outer direction may be a direction opposite to the inner direction. The centers of the first plane heating element 30 and the second plane heating element 50 may be centers of curvature of the outer tracks 31, 32, and 33 or the inner tracks 51, 52, 53, 54, 55, and 56 to be described below.

The first plane heating element 30 may be located outside the second plane heating element 50. Hereinafter, the first plane heating element 30 may be referred to as an outer plane heating element, and the second plane heating element 50 may be referred to as an inner plane heating element.

The outer plane heating element 30 may include outer pattern parts 31, 32, 33, 34 and 35 capable of heating the heating object as evenly as possible and first electrode parts 39A and 39B connected to the outer pattern parts 31, 32, 33, 34 and 35.

The outer pattern parts 31 to 35 may include a start point and an end point which may be connected. The start point and the end point of the outer pattern parts 31 to 35 according to the present embodiment may be parts which are connected to the pair of first electrode parts 39A and 39B.

The outer pattern parts 31 to 35 may include a plurality of outer tracks 31, 32, and 33 and a plurality of outer bridges 34 and 35 connecting the plurality of outer tracks 31, 32, and 33 in series.

Each of the outer tracks 31, 32, and 33 may be curved. More specifically, each of the outer tracks 31, 32, and 33 may have an arc shape. For instance, the outer tracks 31, 32, and 33 may have a major arc shape having an arc angle of greater than 180 degrees, a minor arc shape having an arc angle of less than 180 degrees, or a semicircular shape having an arc angle of 180 degrees. In addition, it may be possible for the outer tracks 31, 32, and 33 to include a combination of two or more of the major arc shape, the semicircular shape, and the minor arc shape.

Through the combination of the arc shapes the outer tracks 31, 32, and 33 may be formed to be long in the circumferential direction of the outer pattern parts 31 to 35.

The centers of curvature C of the plurality of outer tracks 31, 32, and 33 may coincide with each other. The centers C of curvature of the plurality of outer tracks 31, 32, and 33 may be defined as the centers of the outer pattern parts 31 to 35 or the center of the outer plane heating element 30.

The length of each of the plurality of outer tracks 31, 32, and 33 may be different from each other. The widths W1 of the plurality of outer tracks 31, 32, and 33 may be equal to each other.

The widths W1 of the outer tracks 31, 32, and 33 may be different from the widths W2 of inner tracks 51, 52, 53, 54, 55, and 56 to be described below. In the present embodiment, the widths W1 of the outer tracks 31, 32, and 33 may be wider than the widths W2 of the inner tracks 51, 52, 53, 54, 55, and 56.

The plurality of outer tracks 31, 32, and 33 may be spaced apart from each other. More specifically, the plurality of outer tracks 31, 32, and 33 may be spaced apart from each other in the radial direction of the outer pattern parts 31 to 35. A gap g1 between the adjacent outer tracks 31, 32, and 33 may be constant.

The plurality of outer tracks 31, 32, and 33 may include a first outer track 31, a second outer track 32, and a third outer track 33. The first outer track 31 may be referred to as the outermost outer track, the second outer track 32 may be referred to as the middle outer track, and the third outer track 33 may be referred to as the innermost outer track.

A pair of the first outer tracks 31 may be provided. At least a pair of second outer track 32 may be provided. One third outer track 33 may be provided.

The second outer track 32 may be located between the first outer track 31 and the third outer track 33 in the radial direction.

The plurality of outer bridges 34 and 35 may connect the plurality of outer tracks 31, 32, and 33 in series with respect to the current flow direction.

The outer bridges 34 and 35 may connect end parts of the outer tracks 31, 32, and 33 adjacent to each other.

The plurality of outer bridges 34 and 35 may be spaced apart from each other.

The outer bridges 34 and 35 may be larger than inner bridges 61, 62, 63, 64, and 65 to be described below.

The widths of the outer bridges 34 and 35 may be the same as the widths W1 of the outer tracks 31, 32, and 33. However, the widths of the outer bridges 34 and 35 are not limited thereto and the widths of the outer bridges 34 and 35 may be formed to be narrower than the widths W1 of the outer tracks 31, 32, and 33.

The thickness of the outer bridges 34 and 35 in the vertical direction (i.e., height) may be thicker than the thickness of the outer tracks 31, 32, and 33 in the vertical direction in order to minimize the localized heating generated by the difference in path between the inner circumference and the outer circumference of the outer bridges 34 and 35. As a result, the sectional area of the outer bridges 34 and 35 may be larger than the sectional area of the outer tracks 31, 32, and 33, and the resistance difference due to the difference in path may be reduced, and thus localized heating may be reduced. In one embodiment, the outer bridges 34 and 35 may be printed with the same thickness as those of the outer tracks 31, 32, and 33, and then over-coated or may be printed at least two times. However, the process method is not limited thereto.

The heating value of each of the outer bridges 34 and 35 may be smaller than the heating value of each of the outer tracks 31, 32, and 33. The temperature of each of the outer bridges 34 and 35 may be lower than the temperature of each of the outer tracks 31, 32, and 33. In other words, the outer tracks 31, 32, and 33 may be the main heating units of the outer pattern parts 31 to 35 and the outer bridges 34 and 35 may be the sub-heating units 31 to 35 of the outer pattern parts 34 and 35.

The plurality of outer bridges 34 and 35 may include a first outer bridge 34 and a second outer bridge 35. The first outer bridge 34 may connect the first outer track 31 and the second outer track 32 to each other. The second outer bridge 35 may connect the second outer track 32 and the third outer track 33 to each other.

A pair of first outer bridges 34 and a pair of second outer bridges 35 may be provided, respectively.

The pair of first electrode parts 39A and 39B may be connected to the outer pattern parts 31 to 35. The first electrode parts 39A and 39B may be directly connected to the outer pattern parts 31 to 35 or may be connected to the outer pattern parts 31 to 35 by a connector.

The pair of first electrode parts 39A and 39B may include a first positive electrode part 39A and a first negative electrode part 39B. One of the first positive electrode part 39A and the first negative electrode part 39B may be connected to the start point of the outer pattern parts 31 to 35 and the other may be connected to the end point of the outer pattern parts 31 to 35.

In the present embodiment, the start point of the outer pattern parts 31 to 35 may be located at an end part of one first outer track 31 and the end point of the outer pattern parts 31 to 35 may be located at an end part of the other first outer track 31. In other words, the pair of first electrode parts 39A and 39B may be connected to the end part of one first outer track 31 and the end part of the other outer tracks 31, respectively.

The widths of the first electrode parts 39A and 39B may be wider than the widths W1 of the outer tracks 31, 32, and 33.

The outer plane heating element 30 may have a symmetrical shape with respect to an imaginary center line D bisecting the outer plane heating element 30. Here, the imaginary center line D may be an imaginary straight line passing through the center C of the outer plane heating element 30.

The outer pattern parts 31 to 35 may include a first outer pattern part and a second outer pattern part, which are located on opposite sides to each other with respect to the imaginary center line D, respectively. The first outer pattern part and the second outer pattern part may have a shape symmetrical with respect to an imaginary center line D.

The pair of first outer tracks 31 may be located opposite to each other with respect to the imaginary center line D. The pair of second outer tracks 32 may be located opposite to each other with respect to the imaginary center line D. The third outer track 33 may intersect the imaginary center line D. Each of the outer bridges 34 and 35 may be curved so as to protrude toward the imaginary center line D.

The pair of first electrode parts 39A and 39B may be located opposite to each other with respect to the imaginary center line D.

The inner plane heating element 50 may include inner pattern parts 51, 52, 53, 54, 55, 56, 61, 62, 63, 64 and 65, and a second electrode parts 69A and 69B connected to the inner pattern parts 51, 52, 53, 54, 55, 56, 61, 62, 63, 64, and 65.

The inner pattern parts 51 to 56 and 61 to 65 may include a start point and an end point which may be connected. The start point and the end point of the inner pattern parts 51 to 56 and 61 to 65 according to the present embodiment may be parts which are connected to the pair of second electrode parts 69A and 69B.

The inner pattern parts 51 to 56 and 61 to 65 may include a plurality of inner tracks 51, 52, 53, 54, 55, and 56 and a plurality of inner bridges 61, 62, 63, 64, and 65 which connect the plurality of inner bridges 51, 52, 53, 54, 55, and 56 in series.

Each of the inner tracks 51 to 56 may be curved. More specifically, each of the inner tracks 51 to 56 may have an arc shape. For instance, the inner tracks 51 to 56 may have a major arc shape having an arc angle of greater than 180 degrees, a minor arc shape having an arc angle of less than 180 degrees, or a semicircular shape having an arc angle of 180 degrees. In addition, it may be possible that the inner tracks 51 to 56 include a combination of two or more of the major arc shape, the semicircular shape, and the minor arc shape.

Through the combination of the arc shapes the inner tracks to 56 may be formed to be long in the circumferential direction of the inner pattern parts 51 to 56 and 61 to 65.

The centers of curvature C of the plurality of inner tracks 51 to 56 may coincide with each other. The centers of curvature C of the plurality of inner tracks 51 to 56 may be defined as the center of the inner pattern parts 51 to 56 and 61 to 65 or the center of the inner plane heating element 50.

The center of the inner plane heating element 50 may coincide with the center of the outer plane heating element 30 described above. In other words, the centers of curvature C of the inner tracks 51 to 56 and the centers of curvature C of the outer tracks 31, 32, and 33 may coincide with each other.

The length of each of the plurality of inner tracks 51 to 56 may be different from each other. The widths W2 of the plurality of inner tracks 51 to 56 may be equal to each other.

The widths W2 of the inner tracks 51 to 56 may be different from the widths W1 of the outer tracks 31, 32, and 33. In the present embodiment, the widths W2 of the inner tracks 51 to 56 may be narrower than the widths W1 of the outer tracks 31, 32, and 33.

The plurality of inner tracks 51 to 56 may be spaced apart from each other. More specifically, the plurality of inner tracks 51 to 56 may be spaced apart from each other by a predetermined gap in the radial direction of the inner pattern parts 51 to 56 and 61 to 65. A gap g2 between the inner tracks 51 to 56 adjacent to each other may be constant.

The gap g2 between the inner tracks 51 to 56 adjacent to each other may be the same as the gap g1 between the outer tracks 31, 32, and 33 adjacent to each other, but is not limited thereto.

The plurality of inner tracks 51 to 56 may include the outermost inner track 51, the innermost inner track 56, and the middle inner tracks 52, 53, 54, and 55.

A pair of outermost inner tracks 51 may be provided. At least one of middle inner tracks 52, 53, 54, and 55 may be provided. One innermost inner track 56 may be provided.

The middle inner tracks 52, 53, 54, and 55 may be located between the outermost inner track 51 and the innermost inner track 56 in the radial direction.

The outermost inner track 51 may be located inside the innermost outer track 33.

The outermost inner track 51 may be spaced apart from the innermost outer track 33 in the radial direction. A gap g3 between the outermost inner track 51 and the innermost outer track 33 may be constant.

The outermost inner track 51 may be referred to as the first inner track 51. In a case where four pairs of middle inner tracks 52, 53, 54, and 55 are provided as in the present embodiment, each of the middle inner tracks 52, 53, 54, and 55 may be referred to as a second inner track 52, a third inner track 53, a fourth inner track 54, and a fifth inner track 55, respectively. In this case, the innermost inner track 56 may be referred to as a sixth inner track 56.

The plurality of inner bridges 61 to 65 may connect the plurality of inner tracks 51 to 56 in series with respect to the current flow direction.

The inner bridges 61 to 65 may connect the end parts of the inner tracks 51 to 56 adjacent to each other.

The plurality of inner bridges 61 to 65 may be spaced apart from each other.

The inner bridges 61 to 65 may be smaller than the outer bridges 34 and 35.

The width of the inner bridges 61 to 65 may be the same as the widths W2 of the inner tracks 51 to 56. However, the widths of the inner bridges 61 to 65 are not limited thereto, and the widths of the inner bridges 61 to 65 may be formed to be narrower than the widths W2 of the inner tracks 51 to 56.

The thickness of the inner bridges 61 to 65 in the vertical direction may be thicker than the thickness of the inner bridges 61 to 65 in the vertical direction in order to minimize the localized heating generated by the difference in path between the inner circumference and the outer circumference of the inner bridges 61 to 65. As a result, the sectional area of the inner bridges 61 to 65 may be larger than the sectional area of the inner tracks 51 to 56, and the difference in resistance due to the difference in path may be reduced, and thus localized heating may be reduced. In one embodiment, the inner bridges 61 to 65 may be manufactured by being printing to the same thickness as those of the inner tracks 51 to 56, then being over-coated, or being printed at least twice. However, the process method is not limited thereto.

The heating value generated by each of the inner bridges 61 to 65 may be smaller than the heating value generated by each of the inner tracks 51 to 56. The temperature of each of the inner bridges 61 to 65 may be lower than the temperature of each of the inner tracks 51 to 56. In other words, the inner tracks 51 to 56 may be main heating units of the inner pattern parts 51 to 56 and 61 to 65, and the inner bridges 61 to 65 may be sub-heating units of the inner pattern parts 51 to 56.

The plurality of inner bridges 61 to 65 may include a first inner bridge 61 to a fifth inner bridge 65. The first inner bridge 61 may connect the first inner track 51 and the second inner track 52 to each other. The second inner bridge 62 may connect the second inner track 52 and the third inner track 53 to each other. The third inner bridge 63 may connect the third inner track 53 and the fourth inner track 54 to each other. The fourth inner bridge 64 may connect the fourth inner track 54 and the fifth inner track 55 to each other. The fifth inner bridge 65 may connect the fifth inner track 55 and the sixth inner track 56 to each other.

A pair of the first inner bridges 61 to a pair of the fifth inner bridges 65 may be provided.

The pair of second electrode parts 69A and 69B may be connected to the inner pattern parts 51 to 56 and 61 to 65. The second electrode parts 69A and 69B may be directly connected to the inner pattern parts 51 to 56 and 61 to 65 and may be connected to the inner pattern parts 51 to 56 and 61 to 65 by a connector.

The pair of second electrode parts 69A and 69B may include a second positive electrode part 69A and a second negative electrode part 69B. One of the second positive electrode part 69A and the second negative electrode part 69B may be connected to the start point of the inner pattern parts 51 to 56 and 61 to 65, and the other thereof may be connected to the end point of the inner pattern parts 51 to 56 and 61 to 65.

In the present embodiment, the start point of the inner pattern parts 51 to 56 and 61 to 65 may be located at an end part of any one of the first inner tracks 51, and the end point of the inner pattern parts 51 to 56 and 61 to 65 may be located at an end part of the other first inner track 51. In other words, the pair of second electrode parts 69A and 69B may be connected to the end part of the first inner track 51 and the other inner track 51, respectively.

The widths of the second electrode parts 69A and 69B may be wider than the widths W2 of the inner tracks 51 to 56.

The inner plane heating element 50 may have a symmetrical shape with respect to an imaginary center line D bisecting the inner plane heating element 50. Here, the imaginary center line D may be an imaginary straight line passing through the center C of the inner plane heating element 30.

The inner pattern parts 51 to 56 and 61 to 65 may include a first inner pattern part and a second inner pattern part which are located opposite to each other with respect to the imaginary center line D. The first inner pattern part and the second inner pattern part may have a shape symmetrical to each other with reference to an imaginary center line D.

The pair of outermost inner tracks 51 may be located opposite to each other with respect to the imaginary center line D. A pair of middle inner tracks 52, 53, 54, and 55 having the same radius of curvature may be located opposite to each other with respect to the imaginary center line D. The innermost inner track 56 may intersect the imaginary center line D. Each of the inner bridges 61 to 65 may be curved so as to protrude toward the imaginary center line D.

The pair of second electrode parts 69A and 69B may be located opposite to each other with respect to the imaginary center line D.

The pair of second electrode parts 69A and 69B may be located inside the outer plane heating element 30. In more detail, the pair of second electrode parts 69A and 69B may be located inside the outer pattern parts 31 to 35. As a result, compared with a case where a part of the pair of second electrode parts 69A and 69B is located outside the outer pattern parts 31 to 35, in the present embodiment, the heating area of the outer pattern parts 31 to 35 may be formed to be large relatively.

The pair of second electrode parts 69A and 69B may extend inside of the inner pattern parts 51 to 56 and 61 to 65. The pair of second electrode parts 69A and 69B may be connected to the first inner track 51 and may be located inside the first inner track 51. Thus, the second electrode parts 69A and 69B may not invade the heating regions of the outer pattern parts 31 to 35.

More specifically, the second electrode parts 69A and 69B may intersect the imaginary circle C1 including the outer circumference of the second inner track 52. The outer circumference of the second inner track 52 may form a part of the imaginary circle C1.

At least a part of the second electrode parts 69A and 69B may be located between the pair of second inner bridges 62 or may face between the pair of second inner bridges 62.

A distance D2 between the pair of second inner bridges 62 may be wider than at least one of a distance D1 between the pair of first inner bridges 61, a distance D3 between the pair of third inner bridges 63, a distance D4 between the pair of fourth inner bridges 64, and a distance D5 between the pair of fifth inner bridges 65.

The distance D2 between the pair of second inner bridges 62 may be wider than at least one of a distance DD1 between the pair of first outer bridges 34 and a distance DD2 between the pair of second outer bridges 35.

A benefit that may result is that, while preventing the interference and dielectric breakdown between the second electrode parts 69A and 69B and the second inner bridge 62, the heating area of the outer pattern parts 31 to 35 and the inner pattern parts 51 to 56 and 61 to 65 may be increased by occupying the area previously occupied by the second electrode parts 69A and 69B.

The pair of first electrode parts 39A and 39B may extend outside the outer pattern parts 31 and 35. The pair of first electrode parts 39A and 39B may be connected to the first outer track 31 and may be located outside the first outer track 31. Thus, the first electrode parts 39A and 39B does not intrude on the heating regions of the outer pattern parts 31 to 35.

Figure 5:
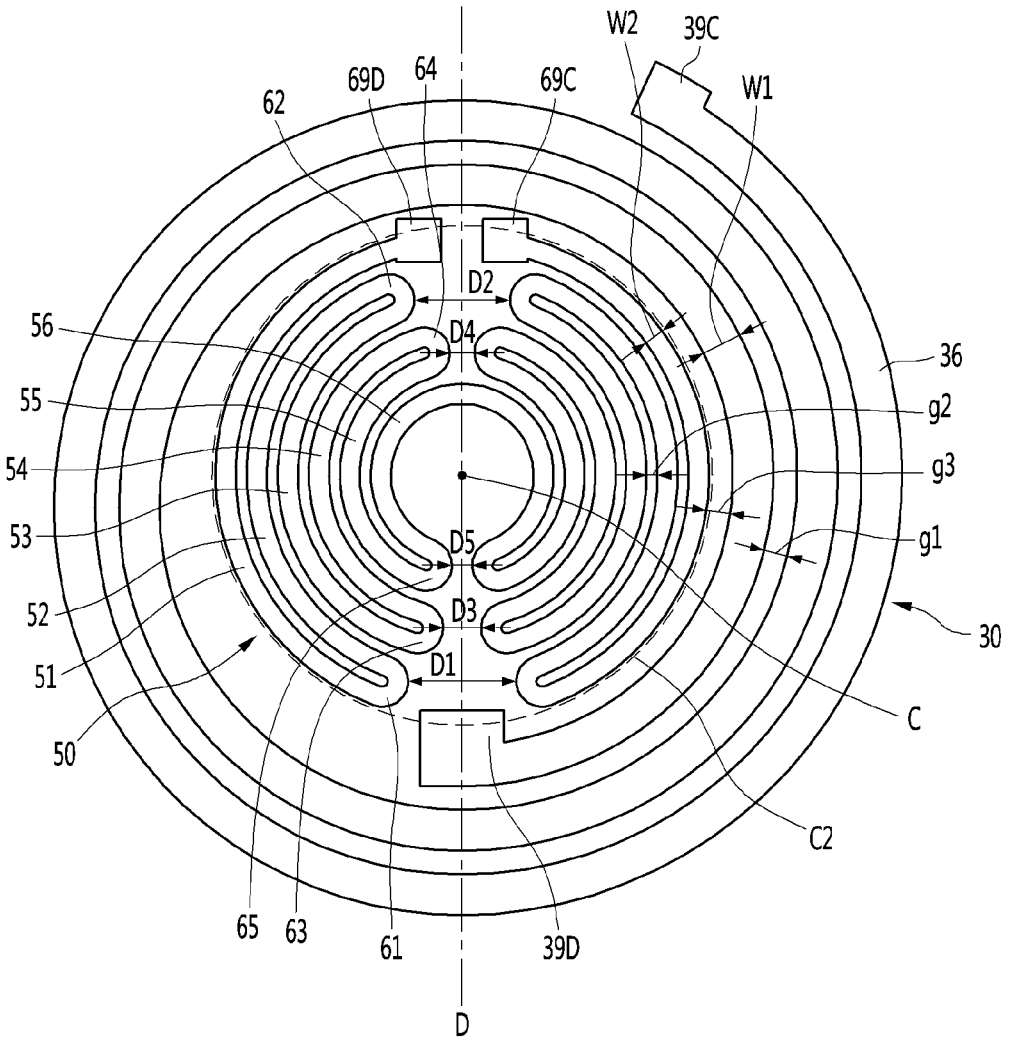
FIG. 5 is a bottom view showing an electric heater according to another embodiment of the present disclosure.

FIG. 5 is a bottom view showing an electric heater according to another embodiment of the present disclosure.

In the present embodiment, the inner pattern parts 51 to 56 and 61 to 65 have the same configuration as the embodiment described above with reference to FIG. 4. Therefore, overlapping contents may be omitted and the differences are mainly explained.

The outer pattern part 36 according to the present embodiment may have a spiral shape. In other words, the outer pattern part 36 includes a spiral outer track 36 including a start point and an end point, but may not have a bridge. Therefore, in the present embodiment, the configuration of the outer track 36 may be the configuration of the outer pattern part 36.

Since the outer pattern part 36 does not include a bridge, the outer pattern part 36 may have an advantage that localized heating generated in a normal bridge does not occur. The configuration of the outer pattern part 36 may be possible by positioning third electrode parts 69C and 69D connected to the inner pattern parts 51 to 56 and 61 to 65 on the inside of the outer pattern part 36.

At least one of fourth electrode parts 39C and 39D may be spaced apart from the inner pattern parts 51 to 56 and 61 to 65 50 on the inside of the outer pattern part 36.

The pair of fourth electrode parts 39C and 39D may be connected to the outer pattern part 36. Any one of the pair of fourth electrode parts 39C and 39D may be connected to the start point of the outer pattern part 36 and the other thereof may be connected to the end point of the outer pattern part 36.

The pair of fourth electrode parts 39C and 39D may include an outer electrode part 39C and an inner electrode part 39D. In other words, one of the pair of fourth electrode parts 39C and 39D may be an outer electrode part 39C and the other thereof may be an inner electrode part 39D.

The outer electrode part 39C may extend to the outside of the outer pattern part 36 and the inner electrode part 39D may extend to the inside of the outer pattern part 36.

The inner electrode part 39D may be spaced apart from the inner plane heating element 50. More specifically, the inner electrode part 39D may be spaced apart from the inner pattern parts 51 to 56 and 61 to 65. A benefit may be that a dielectric breakdown between the inner electrode part 39D and the inner pattern parts 51 to 56 and 61 to 65 may be prevented.

The inner electrode part 39D may intersect the imaginary circle C2 including the outer circumferences of the inner pattern parts 51 to 56 and 61 to 65. That is, the outer circumferences of the inner pattern parts 51 to 56 and 61 to 65, more specifically, the outer circumference of the first inner tracks 51 forms a part of the imaginary circle C2 and the inner electrode part 39D may intersect the imaginary circle C2.

At least a part of the inner electrode part 39D may be located between the pair of first inner bridges 61 and may face between the pair of first inner bridges 61.

The inner electrode part 39D may intersect the imaginary center line D passing through the centers C of the inner pattern parts 51 to 56 and 61 to 65. As described above, the inner pattern part 39D may have a symmetrical shape with respect to the imaginary center line D.

The distance D1 between the pair of first inner bridges 61 can be wider than a least one of the distance D2 between the pair of second inner bridges 62, the distance D3 between the pair of third inner bridges 63, the distance D4 between the pair of fourth inner bridges 64, and the distance D5 between the pair of fifth inner bridges 65.

One benefit that may result is that, while preventing interference and insulation breakdown between the inner electrode part 39D and the first inner bridge 61, the heating area of the inner pattern parts 51 to 56 and 61 to 65 may be increased.

A gap g1 between the parts adjacent to each other in the radial direction of the outer track 36 may be constant. The gap g2 between the inner tracks 51 to 56 adjacent to each other may be constant. However, the gap g3 between the first inner track 51 and the outer track 36 may not be constant and may gradually be farther away or decreased along the length direction of the outer track 36.

Figure 6:
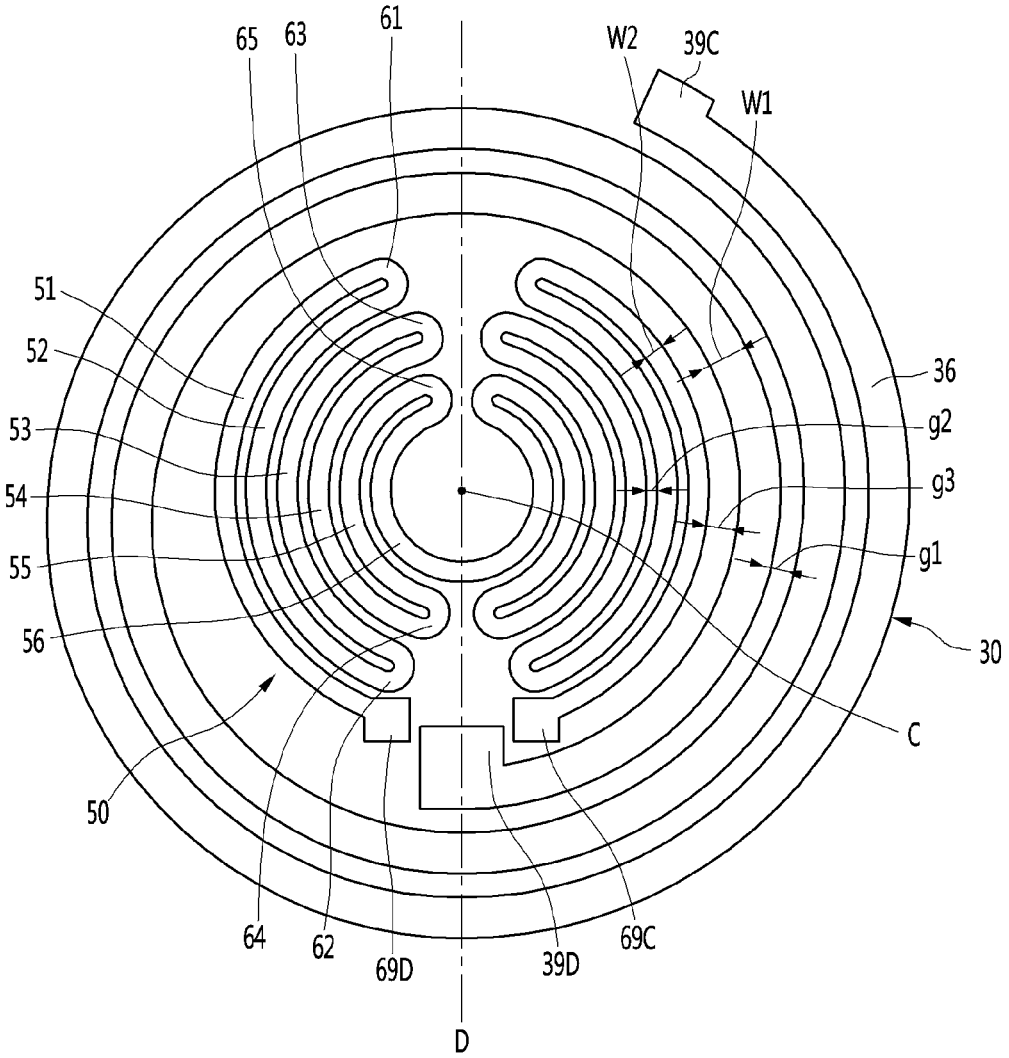
FIG. 6 is a bottom view showing an electric heater according to another embodiment of the present disclosure.

FIG. 6 is a bottom view showing an electric heater according to another embodiment of the present disclosure.

The inner plane heating element 50 of the present embodiment may be similar to an inverted shape of the inner plane heating element 50 shown in FIG. 5 with respect to the transverse axis passing through the center C.

In a case of the present embodiment, at least a part of the inner electrode parts 39D may be located between a pair of third electrode parts 69C and 69D. The inner electrode part 39D may face between the pair of third electrode parts 69C and 69D. The inner electrode part 39D may be spaced apart from each of the third electrode parts 69C and 69D.

One benefit may be that an insulation breakdown may not occur between the inner electrode part 39D and the third electrode parts 69C and 69D.

The inner electrode part 39D and the third electrode parts 69C and 69D may be disposed adjacent to each other with the above-described configuration. One benefit may be it may be easy to supply current to any one of the third electrode parts 69C and 69D and the inner electrode part 39D. For example, in a case where the inner electrode part 39D is a negative electrode part, since the third negative electrode part 69D and the inner electrode part 39D are adjacent to each other, the electric wire or the like may be easily connected to the third negative electrode part 69D and the inner electrode part 39D and the length of the electric wire or the like may be shortened as compared with a case where the third negative electrode part 69D and the inner electrode part 39D are farther away.

While embodiments of the present disclosure have been described above with reference to the drawings, the present invention is not limited to the above-described embodiments, and it will be apparent to those skilled in the art that the embodiments may be modified without departing from the spirit and scope of the present invention. It will be understood that modifications and variations are possible. Therefore, the scope of the present invention should not be defined by the described embodiments, but should be determined by the technical spirit described in the claims.

What is claimed is:

1. An electric heater comprising:

a substrate;

an outer pattern part disposed on one surface of the substrate;

an inner pattern part disposed on the one surface of the substrate so as to be located such that the outer pattern part surrounds the inner pattern part, and to be spaced apart from the outer pattern part;

a pair of first electrodes connected to the outer pattern part; and a pair of second electrodes connected to the inner pattern part and spaced apart from the pair of first electrodes, wherein the pair of second electrodes are located inside the outer pattern part, wherein the outer pattern part has a spiral shape, wherein the inner pattern part includes:

a pair of first inner tracks having an arc shape and to which the pair of second electrode parts are connected to one end of the pair of the first inner tracks, respectively, and the pair of the first inner tracks are located at an outermost side of the inner pattern part with respect to a center of the inner pattern part;

a pair of second inner tracks having an arc shape, located inside the first inner track, and spaced apart from the first inner track; and a pair of first inner bridges connecting respective other end of the first inner track and the second inner track in series;

wherein the pair of first electrodes include:

an outer electrode extending outwardly from an end of the outer pattern part; and an inner electrode extending inwardly from another end of the outer pattern part and an end of the inner electrode located between the pair of first inner bridges connecting the respective other end of the first inner track and the second inner track in series, and the end of the inner electrode is spaced apart from the inner pattern part, wherein an end of the pair of second electrodes are located between the outer pattern part and the pair of first inner tracks, and the end of the pair of second electrodes do not extend out from an area formed on the one surface of the substrate by an inner boundary of the outer pattern part.

2. The electric heater of claim 1, wherein the pair of second electrodes extend inwardly from the inner pattern part.

3. The electric heater of claim 1, wherein the pair of second electrodes intersect an imaginary circle including an outer circumference of the second inner track.

4. The electric heater of claim 3, wherein a gap between the first inner track and the second inner track is constant.

5. The electric heater of claim 3, wherein the inner pattern part further includes:

a pair of third inner tracks having an arc shape, located inside the second inner track, and spaced apart from the second inner track; and a pair of second inner bridges connecting the second inner track and the third inner track to each other in series, and wherein the pair of second electrodes face between the pair of second inner bridges.

6. The electric heater of claim 3, wherein the inner pattern part further includes:

a pair of third inner tracks having an arc shape, located inside the second inner track, and spaced apart from the second inner track; and a pair of second inner bridges connecting the second inner track and the third inner track to each other in series, and wherein a distance between the pair of second inner bridges is wider than a distance between the pair of first inner bridges.

7. The electric heater of claim 1, wherein the inner electrode intersects an imaginary circle including an outer circumference of the inner pattern part and is spaced apart from the inner pattern part.

8. The electric heater of claim 1, wherein at least a part of the inner electrode is located between the pair of second electrodes.

9. The electric heater of claim 1, wherein the inner pattern part has a symmetrical shape with respect to an imaginary center line passing through the center of the inner pattern part, and wherein the inner electrode intersects the imaginary center line.

10. The electric heater of claim 1, wherein a gap between the first inner track and the outer pattern part is varied along a length direction of the outer pattern part.

11. An electric heating apparatus including the electric heater of claim 1.

* * * * *